United States Patent [19]

Mosnier

[11] Patent Number: 4,594,086

[45] Date of Patent: Jun. 10, 1986

[54] METHOD AND APPARATUS FOR DISTRIBUTION OF FIBRES IN A FELT

[75] Inventor: Francis Mosnier, Coye la Foret, France

[73] Assignee: Isover Saint-Gobain, Aubervilliers, France

[21] Appl. No.: 583,608

[22] Filed: Feb. 27, 1984

[51] Int. Cl.[4] ..... C03B 37/05; C03B 37/06

[52] U.S. Cl. ..... 65/4.4; 65/9; 156/62.4

[58] Field of Search ..... 65/4.4, 6, 8, 9, 14–16; 156/62.4

[56] References Cited

U.S. PATENT DOCUMENTS

| | | | |
|---|---|---|---|
| 2,317,895 | 4/1943 | Drill | 65/4.4 |
| 2,319,666 | 5/1943 | Drill | 65/4.4 |
| 3,159,475 | 12/1964 | Chen et al. | 65/15 |
| 3,539,316 | 11/1970 | Trethewey | 65/9 X |
| 3,746,524 | 7/1973 | Kirchheim | 65/6 |
| 4,058,386 | 11/1977 | Faulkner | 65/6 |
| 4,356,017 | 10/1982 | Ankersson | 65/8 |

FOREIGN PATENT DOCUMENTS

| | | | |
|---|---|---|---|
| 541801 | 3/1977 | U.S.S.R. | 65/9 |

*Primary Examiner*—Robert Lindsay

*Attorney, Agent, or Firm*—Oblon, Fisher, Spivak, McClelland & Maier

[57] ABSTRACT

The present invention relates to the formation of fibre felts which are produced on centrifugation wheels, the material to be fiberized being conducted to the periphery of these wheels from the outside thereof, and the fibres being carried by gaseous currents to the receiving device (9).

In order to improve the distribution of the fibres within these felts, additional gaseous jets are blown on the sides of the gaseous currents carrying the fibres along the lateral walls (10,11) bordering the receiving device (9).

The invention enables satisfactory transverse distribution of the fibres to be achieved.

8 Claims, 10 Drawing Figures

METHOD AND APPARATUS FOR DISTRIBUTION OF FIBRES IN A FELT

The present invention relates to techniques for the formation of fibre felts, in which the fibres are produced by centrifugation. The invention relates more particularly to those techniques in which the fibres are produced by directing the attenuable material from outside to the periphery of one or more centrifugation wheels and the fibres are entrained by a gaseous current extending along the peripheral wall of the one or more than one centrifugation wheel.

The formation of fibres by these techniques and particularly of glass fibres, is well known. Details of the conditions for carrying out this process may be found, in particular, in the present Applicant's published Patent Application No. FR-A-2 500 492.

The means employed in these techniques for receiving the fibres with a view to forming the felts comprise a certain number of arrangements which are highly specific to this type of attenuation.

Firstly, it is important to emphasize that the wheels are normally arranged so that their axis of rotation is horizontal or close to the horizontal. The gaseous currents which participate in the formation of the fibres by carrying them along but also by exerting an attenuating action close to the centrifugation wheels are normally generated parallel to the axis of rotation. The process is also preferably carried out in such a manner that the fibres are subjected to a homogeneous treatment, no matter what the zone of the wheel from which the fibres originate. For this purpose, the gaseous current should extend along the wall of the wheel at a close distance therefrom and approximately parallel to the peripheral wall. Under these conditions, the gaseous currents are close to the horizontal, at least at their origin.

These centrifugation techniques, even when carried out under the most efficient conditions such as those described in the above mentioned Patent Application, cannot completely prevent the projection of non-fiberized substances immediately below the fiberization apparatus or slightly in advance thereof on the path followed by the gaseous current carrying the fibres. The means of receiving the fibres for the formation of the felt is therefore advantageously situated at a certain distance from the centrifugation apparatus, so that a dynamic selection takes place which automatically eliminates the largest of the non-fiberized particles.

In practice a cavity is normally formed under the centrifuge to receive the non-fibrous particles while the receiving device in the form of a perforated conveyor belt is placed at a distance depending upon the characteristics of the gaseous flow carrying the fibres.

The fibres carried by the gaseous currents are directed towards a receiving chamber extending in the general direction of these currents. In this chamber, the gaseous currents progressively slow down, thereby preventing excessively violent impact of the fibres with the conveyor which forms the bottom of the receiving chamber.

This slowing down of the gaseous currents carrying the fibres is due to the entrainment of a mass of surrounding air, which increases as the "driving" gaseous current progresses.

Due to the length of the receiving chamber and hence of the path of the gas, a certain amount of sedimentation of fibres takes place along this path. Moreover, the conveyor extends in a direction closely corresponding to that followed by the gaseous current.

An atmosphere of reduced pressure is maintained underneath the conveyor. Due to this vacuum, the gas carrying the fibres is sucked through the conveyor, depositing the fibres as it passes through. This suction contributes to the deflection of the path of fibres and of the gas towards the conveyor.

It will be understood that the circulation of gas and fibres in installations of this type is subjected to numerous influences and that homogeneous distribution of the fibres on the conveyor is difficult to ensure. It is necessary to take into account not only the flow of gas taking part in the process of attenuation but also the influence of induced currents which modify the distribution of the fibres as well as the preferential currents liable to be produced by the suction through the conveyor. Lastly, it is also necessary to consider the geometry of the chamber, which may be the cause of important modifications in the circulation of these currents. If, in earlier publications relating to these techniques, it has been attempted by various means, including modifications in the characteristics of the driving gas or of the induced gas, to improve the phenomena leading to the formation of fibres, it would nevertheless seem that questions concerning the distribution of fibres within the felt have not been deeply studied. This question is, however, of great importance since the quality of the product obtained is directly connected with the uniformity of this distribution. If a product is homogeneous, it may be much thinner and therefore require less material, less transport, etc. than a less homogeneous product having the same insulating properties. In order to obtain at every point of the felt a mass per unit surface area at least equal to the value required for obtaining a given quality in the end product, the overall quantity of fibres required may be from 15 to 20% higher if the fibres are not homogeneously distributed.

The mechanical properties of the products, in particular those relating to compression, are also very sensitively influenced by the homogeneity of distribution of the fibres.

It is therefore particularly desirable to obtain a product in which the fibres are uniformly distributed. One aspect to be considered for this purpose is the distribution of the fibres transversely to the conveyor. It appears to be very difficult to obtain a uniform deposition of fibres over the whole width of the conveyor under conventional conditions. The fibres are normally found to be more densely deposited at the edges of the felt, with a "hollow" left at the centre of the felt.

The causes for this form of transverse distribution are not well known.

It is worth noting that this effect is the opposite of that observed in the case of felts formed with apparatus such as those described in the publication No. FR-A-2 510 909. When these apparatus are used, for which the fibres are obtained by centrifuging the material through orifices situated on the peripheral wall of a centrifuge, the fibres are found to be more densely deposited at the centre of the conveyor. Comparisons are in any case difficult to make when, quite apart from the means employed for forming the fibres, the general arrangement of the fibre forming installation is completely different. In particular in the techniques described in the above mentioned publication, the gas current is directed vertically downwards and the conveyor is arranged transversely to the path of this current.

Certain hypotheses may be brought forward to explain the causes of the form of distribution found, one of the most simple hypotheses being as follows:

The attenuating gas current is conducted in a direction substantially parallel to the axis of the wheel or wheels. In contact with said wheel or wheels and with the fibres, the gas current may be modified and assume a turbulent form which would have the tendency to project the fibres to the outside and thus towards the edges of the conveyor. The presence of the side walls in the receiving chamber, along the conveyor, would constitute an obstacle in the path of the fibres towards the outside and would cause an accumulation of fibres at the foot of these walls.

Although this explanation has the merit of simplicity, it does not completely account for the observed phenomena.

Whatever the true explanation may be, the distribution of fibres on a felt prepared by traditional methods is not satisfactory, and the present invention proposes to improve this distribution.

It has been found, in the course of research carried out by the inventors, that it is possible to obtain a substantially improved distribution by providing an additional blast in the direction of progression of the gas current carrying the fibres, this blast being situated at the sides of this current and extending along the walls bordering the receiving conveyor.

Previously, in techniques for fibre formation such as that described in the publication No. FR-A2 510 909, it has been proposed to improve the distribution of the fibres within the felt by modifying the pathway of the gas current. In that case, the object of providing additional gas jets was to ensure that the gas current carrying the fibres would cover the whole width of the conveyor, this being achieved either by modifying the geometry of the gas current carrying the fibres, for example as described in the present Applicants' publication No. FR-A-2 510 909, or by subjecting the gas current to impulsions which deflect the current alternately so as to cause it to sweep over the whole width of the conveyor. In that case, the use of these additional jets is again characterised by the fact that the jets are emitted close to the origin of the current carrying the fibres so that modification of the current will be as efficient as possible. In other words, the point of emission of the additional jets is situated in the receiving chamber at some distance from the conveyor.

The arrangements according to the present invention are fundamentally different. Firstly, the technique of fiberization and the type of installation in which the invention is carried out are of a different nature, as already indicated above. According to the present invention, the additional gas jets do not have the object of spreading out the gas current carrying the fibres nor of periodically varying the direction of this current, and the emission of additional jets according to the present invention is localized close to the conveyor and not at the origin of the gas current in the receiving chamber.

The characteristics of the additional jets may be adjusted as a function of numerous elements specific for each installation but certain points are common to all embodiments.

Thus the jets emitted may be highly energetic, that is to say they may be emitted under a high pressure, but it has been found experimentally that very satisfactory results may be obtained at a lower cost by using jets at a low pressure. This confirms the difference in the mode of action of jets according to the present invention from the jets used in other techniques for influencing the distribution of fibres. In these other techniques, modification of the path of the gas current carrying the fibres requires a relatively high expenditure of energy not required in the present invention.

Another important factor is that the additional jets are emitted along the side walls bordering the conveyor, and thus substantially in the direction of propagation of the current carrying the fibres. When the direction of gas current requires to be modified, as is the case in the other techniques mentioned above, the jets are directed transversely to the path of the current, either perpendicularly to this path or at least at a considerable angle thereto. According to the present invention, on the other hand, it has been found in practice that when the angle of the additional jets to the direction of the gas current carrying the fibres or to the side walls of the receiving chamber, which amounts to the same, is too great, the effect of these jets on the distribution decreases and may even be eliminated. The angle of the jets to the walls is therefore advantageously below 20°. In practice, it is preferable to direct the jets parallel to the walls and in a direction parallel to the conveyor.

The energy communicated to the additional jets is relatively small. We have seen that the pressure of the jet at the orifice need not be high. The volume of gas required is also relatively small compared with the mass of fibre-carrying gas which is sucked through the conveyor. This quantity of gas ejected is regulated as a function of the intensity of the effect to be obtained. By way of simplification, it may be considered within certain limits that the greater the quantity ejected, the more pronounced will be the effect.

However, the quantity ejected must not be too high, since it has been found that the effect then diminishes and may even be cancelled out. Suitable limits may be determined for each case by simple tests.

Experimentally, it has been found that for satisfactory distribution of the fibres, the mass of additional gas required to be ejected is normally not more than 2 to 3% of the total mass of gas sucked through to the underneath of the conveyor.

The conditions for emission are such that the gas jets have a velocity of the same order as that of the gas currents at the same level, or substantially greater.

The additional jets are emitted along the gas current. They need not cover the whole height of the side walls, It is sufficient if they are localized at the mean level of the gas flow carrying the fibres, and they may also advantageously be slightly shifted towards the conveyor. The additional jets should, however, not be blown directly along the conveyor, as this could completely sweep away the fibres deposited thereon, a minimum distance of 0.3 m being preferably allowed between the conveyor and the point of emission closest to the conveyor.

The mechanism for producing the blast of additional jets according to the present invention to improve the supply of fibres to the centre of the conveyor and consequently reduce the mass of fibres per unit surface area at the edges has not been any better elucidated than the reason for the irregular distribution which occurs in the absence of this invention. When one considers how the accumulation of fibres on the conveyor develops from one end of the receiving chamber to the other, the only conclusion which may be drawn is that the mechanism encountered is a complex one which cannot be reduced to a single effect. This will be seen from a study of the examples.

The invention is explained in more detail in the description given below with reference to the attached drawings, in which FIG. 1 is a schematic view in perspective of the part of an installation in which the fibres are produced and then collected to form the felt, FIG. 2 is a side view analogous to FIG. 1, in which the front walls of the installation have been removed to show the path of the fibres and their deposition on the conveyor, FIG. 3 shows schematically, in transverse section, the distribution of fibres obtained in the felt in the absence of the present invention, FIG. 4 is a view from above, showing the arrangement of the additional jets under conditions not conforming to the present invention, FIG. 5 is a detailed view of an embodiment of the device for producing the additional blast according to the invention.

Figure 8:
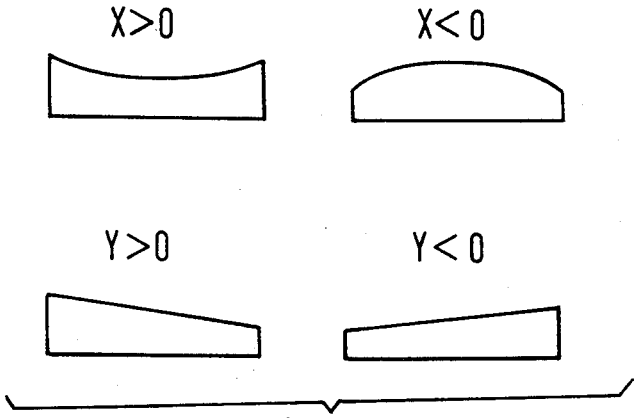
Figure 9:
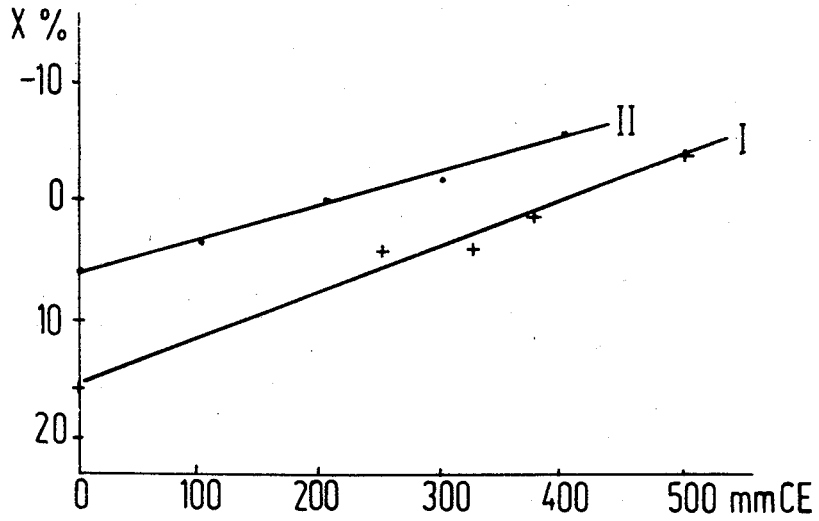
Figure 10:
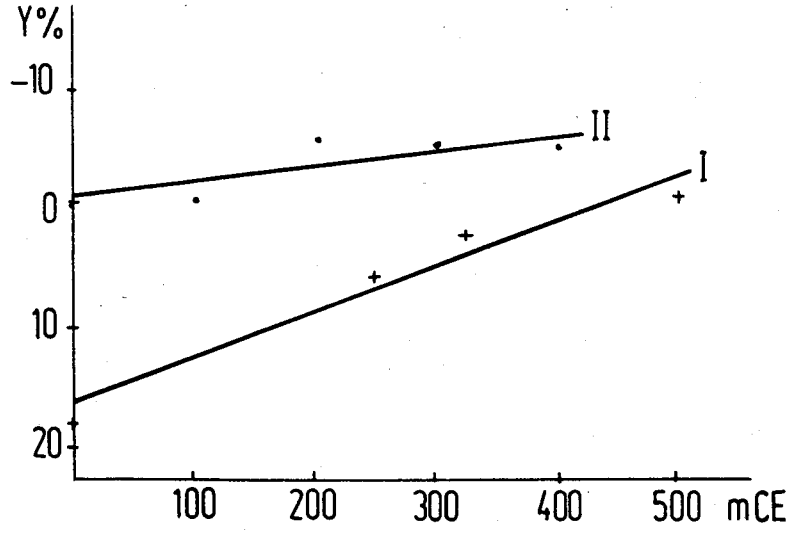

FIG. 8 shows schematically the four types of distribution serving as a basis to characterise the forms of distribution observed in practice, FIG. 9 is a graph showing the influence of the pressure of the blast according to the invention on a parameter of measurement of the distribution, FIG. 10 shows the influence of the pressure of the blast according to the invention on another parameter for measurement of the distribution.

Figure 1:
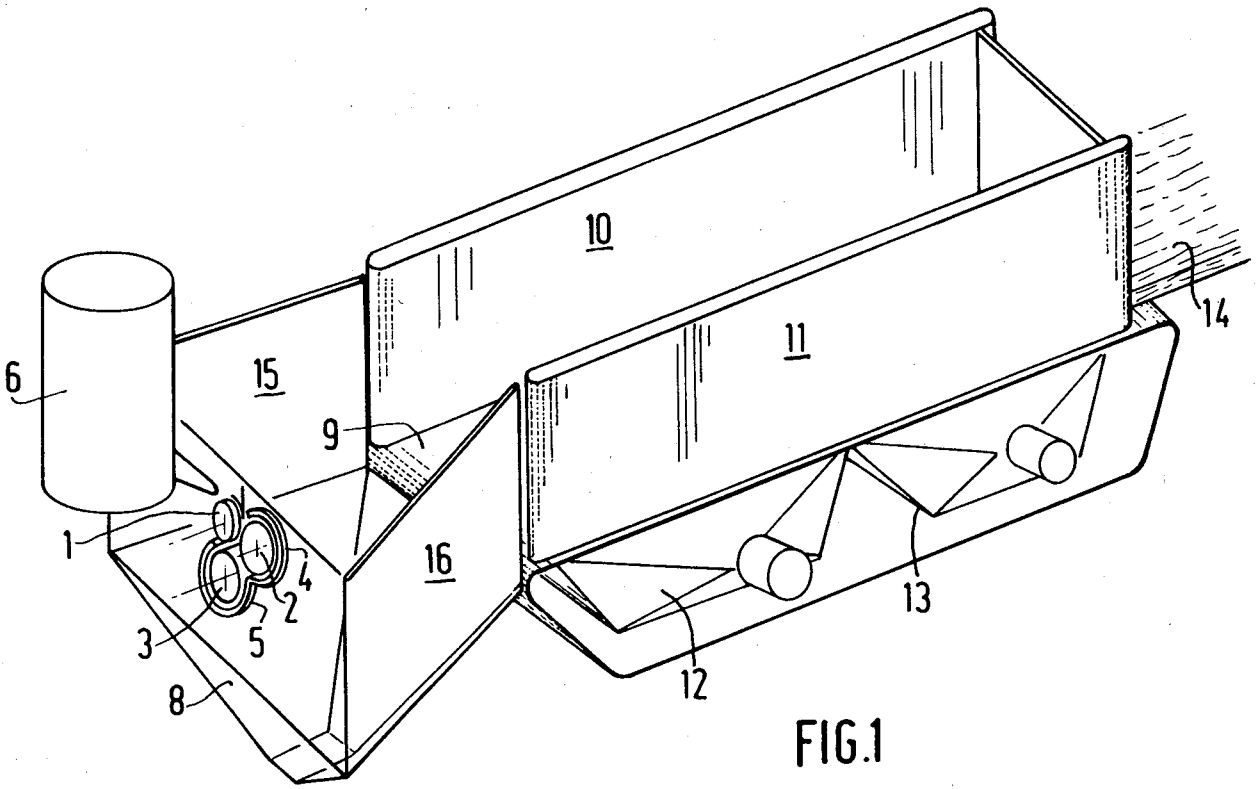

The part of the installation shown in FIG. 1 essentially comprises the apparatus for fibre formation and the receiving chamber in which the felt is formed.

The apparatus for fibre formation comprises an arrangement of three wheels 1, 2, 3 rotating in opposite senses to each other and rings 4, 5 producing a gas current at the periphery of the fiberizing wheels.

The material is fed in from a furnace or crucible 6 and flows over a spout 7 to the first wheel 1, known as the distribution wheel because its main function is to accelerate the material and only few fibres become detached from it.

The material which has been accelerated in contact with the wheel 1 is projected on to the wheel 2. A proportion of the material adheres to this second wheel and is then projected in the form of fine filaments by centrifugation. The remainder of the material is conveyed to the wheel 3 where it adheres and forms filaments in the same manner as on wheel 2.

The filaments which become detached from the wheels are carried along (and attenuated when they are under suitable conditions) by a gas current ejected from the blast rings 4 and 5 surrounding the wheels from which the fibres become detached.

An additional ring may at least partly surround wheel 1 when this wheel also serves to produce fibres.

The apparatus shown is typical of an installation for the formation of mineral fibres, in particular fibres produced from materials having a very high melting point, such as basaltic rock, foundry slag, etc. Analogous installations having centrifugation devices with one, two or four wheels are also conventionally used for this type of production.

Means for projecting a composition of binder on the fibres carried by the gas current are normally provided close to the wheels or directly on the wheels. These means have not been shown.

Underneath and before the centrifugation device is situated a hopper 8 for collecting the non-fiberized particles which have been directly projected from the centrifugation device or those which, because they are too dense. "sediment" before reaching the receiving conveyor 9.

The horizontal distance between the fibre-forming device and the conveyor 9 is of the order of 2 to 3 m, which is sufficient to enable a relatively high proportion of the non-fiberized or insufficiently fiberized particles to be eliminated.

The receiving chamber in which the fibres and the gas currents carrying the fibres circulate is virtually closed. The only openings enabling a significant quantity of air to be introduced from outside are situated behind the centrifugation apparatus and at the level of the hopper 8. These openings and the induced air which they enable to enter facilitate sufficient development of the gas flow inside the receiving chamber.

This receiving chamber is closed at the bottom by the conveyor 9 and laterally, along the conveyor, by the walls 10 and 11.

For reasons mainly of convenience of maintenance, the walls 10 and 11 are advantageously rotatable and displaceable in the same direction as the conveyor 9.

Between the part of the chamber bounded by the conveyor and the movable side walls and the end carrying the centrifugation device, the continuity is provided by fixed metal walls 15, 16 which are required to be highly resistant in view of the non-fiberized particles which strike against them. Flaps made of flexible material (not shown) are fixed to the ends of the walls 15 and 16. These flaps, which fit against the movable wall 10 and 11, seal the chamber at this level.

The chamber is also closed in its upper part, but for reasons of clarity this has not been shown in FIG. 1.

Suction boxes 12 and 13 are arranged under the conveyor 9 over the whole length thereof. These boxes, which are maintained at a lower pressure than the receiving chamber, evacuate the gas carrying the fibres after the fibres have been held back on the conveyor.

Figure 2:
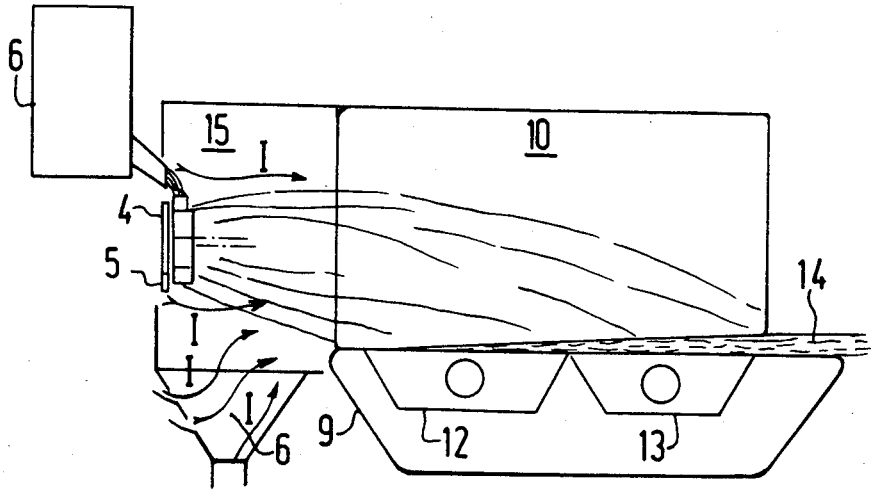

FIG. 2 shows approximately the path followed by the gas and the fibres.

The movement of the gas currents circulating in the receiving chamber is controlled by the attenuating gas emitted along the centrifugation wheels. It is also controlled by the suction maintained under the receiving conveyor and, added to these effects, are those resulting from the induction of ambient air.

The quantity of gas passing through the conveyor 9 is very much greater than that emitted by the blower rings 4 and 5. For the most part, the gas sucked into the boxes 12 and 13 has entered the receiving chamber through openings provided for the entry of "induced" air. The openings in question are situated mainly at the level of the hopper 8 and on that wall of the chamber on which the fibre-forming device is situated.

The arrows I indicate the broad lines of flow of the induced air.

In the hopper 8, the air circulates in countercurrent to the particles projected from the centrifugation wheels. This movement completes the selection required for separating the fibres from non-fiberized particles.

Inside the receiving chamber, the direction of displacement of the fibres is on the whole close to the horizontal. This direction is deflected towards the receiving conveyor by the suction effect. The fibres are progressively deposited on the conveyor 9 to form the felt 14, the thickness of which increases right up to the outlet of the chamber.

The circulation of gas inside the chamber is very turbulent and it is not possible to present a precise path but only the overall movement.

Figure 3:
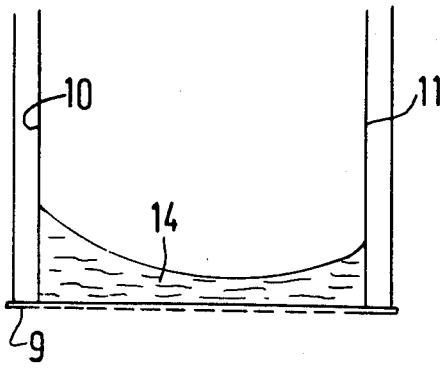
FIG.3 PRIOR ART

The distribution of fibres obtained in the absence of the present invention is of the type shown in FIG. 3. Two defects are normally observed, namely a hollow in the middle of the felt or, what is equivalent thereto, an excess of fibres at the edges, and an inequality between one side and the other.

A more detailed analysis of the manner in which the fibres are deposited along the conveyor shows the complexity of the problem. In the course of their studies, the inventors have found that at the beginning, that is to say on the part of the conveyor close to the fibre forming apparatus, deposition is more abundant at the centre than at the edges and that the tendency is progressively reversed as formation of the felt continues, right up to the other end of the receiving chamber.

Figure 4:
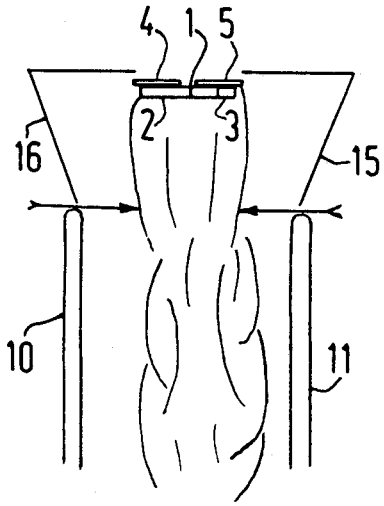
FIG.4 PRIOR ART

It is worth noting that attempts to modify the path of the current carrying the fibres have not succeeded in overcoming these faults of distribution. In particular, the inventors have attempted, without success, to modify this current by means of gas jets directed transversely to the general path of the fibres close to the fibre forming device. The direction of the additional jets was as indicated in FIG. 4. In this arrangement and for rates of gas flow comparable to those employed in the present invention, it was not possible to obtain any satisfactory modification in the distribution of the fibres.

On the other hand, the inventors surprisingly found that a substantial modification in the distribution could be achieved by blowing relatively small quantities of gas along the lateral walls 10 and 11.

Figure 5:
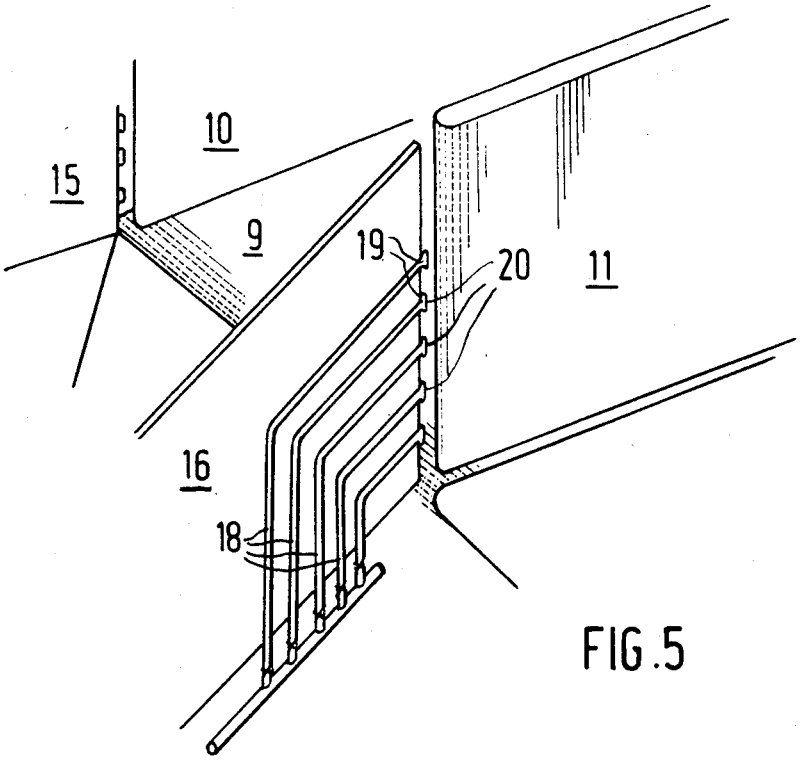

FIG. 5 shows part of FIG. 1 on an enlarged scale, illustrating one embodiment of the present invention. In this case, blast pipes 18 carry air under pressure to blast nozzles 19 situated at the boundary between the walls 16 and 11.

A minimum space is always provided in this location so as not to obstruct the movement of the wall 11. This space is sufficient to accommodate the nozzles, which are flattened at their end containing the emitting orifice 20 to form flat jets. The sealing flap has been omitted, as in FIG. 1.

This figure shows only one side of the apparatus. Analogous pipes are, of course, also provided to produce a blast at the boundary between the walls 15 and 10.

The axis of the blast nozzles is substantially parallel to the movable wall 11 so that the jets emitted from the nozzles extend along this wall.

Figure 6:
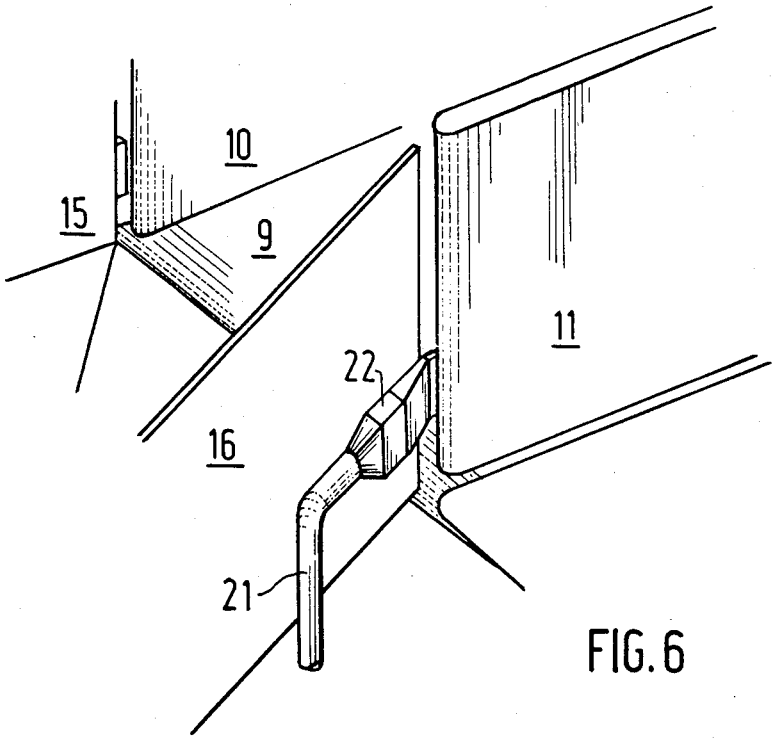
FIG. 6 is a view of another embodiment of the present invention.

In FIG. 5, five distinct nozzles carry the additional gas to different levels along the wall 11. Other arrangements could be employed without altering the mode of operation of the whole arrangement. In particular, a blast could be ejected from a single orifice, preferably an elongated orifice, to distribute the gas over a certain height, as in the apparatus shown in FIG. 6.

In this figure, the gas delivered from the pipe 21 is emitted by the single nozzle 22. The blast is produced slightly below the mean path of the fibres, which is determined at their origin by the position of the centrifugation wheels, and at a certain distance from the conveyor 9.

The vertical position of the blowers may vary within certain limits. Tests may be carried out to determine in each case the optimum position, that is to say the position at which an additional jet provides the greatest modification, the other characteristics of the jet remaining constant.

It is very important to maintain accurately the direction of the jets. If the nozzles are pivoted so that the jet departs from the wall, the effect on the distribution is rapidly diminished.

Figure 7:
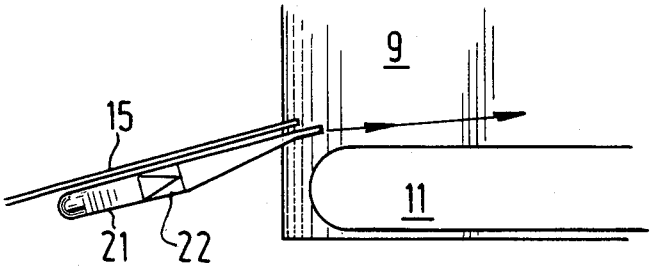
FIG. 7 is a view from above of the apparatus shown in FIG. 6.

FIG. 7 shows the position of the nozzles and the direction of the jets emitted. The nozzles are placed along the walls 15 and 16 and at the end thereof, slightly before the rotatable walls, the end of the nozzle being virtually at the level where the wall becomes planar. In this position, the jets enter the receiving chamber as soon as they have been emitted; this ensures maximum efficiency of the jets.

The nozzles could also extend further forwards to the inside of the receiving chamber, but this arrangement does not appear to provide any additional improvement. In fact, the nozzle, which must be self-supporting, does not enter very far into the chamber. Moreover, if the nozzle were to extend further forwards, it would constitute a particular point along the wall on which the fibres would be liable to get caught, which is not desirable.

Tests were carried out with pressures varying widely, from 0.1 to 4 bars. The most suitable pressure in each particular case depends upon the particular blast nozzles. The results, as will be shown later, depend upon the mass of gas ejected, and nozzles having small orifices therefore require the employment of a higher pressure.

It would seem advantageous in practice to increase the dimensions of the emission orifices and operate at a low pressure. The production costs of such jets is less and the use of such larger jets ensures better distribution over the gas currents circulating in the receiving chamber.

Results of tests carried out according to the present invention to improve the transverse distribution of fibres forming a felt are given below by way of example. The tests were carried out in an installation of the type illustrated in FIG. 1.

The additional blowers used comprise a single blast nozzle on each side of the installation. These nozzles, analogous to that illustrated in FIG. 6, have an orifice elongated over 500 mm for a width of 25 mm.

The blowers are supplied from a low pressure fan. They are adjusted independently of one another by two separate valves.

The distribution of fibres is measured by means of an X-ray probe. This is a movable probe and is displaced transversely to the conveyor. It acts on the felt leaving the receiving chamber.

The results of measurements of the density of fibres by X-ray absorption are analysed by distinguishing three zones on the felt: A central zone and two lateral zones. These three zones all have the same width.

The distribution is represented by two values, a "degree of hollowness", which expresses the unevenness of distribution between the centre and the edges of the felt, and a degree of "slope", which expresses the difference between the two edges.

If the terms A, B and C are used to express the measurements corresponding, respectively, to the mass of fibres per unit surface area at one side, the centre and the other side of the felt, the degree of hollowness is determined by the formula:

$$X=(A+C)/2B\times 100-100$$

while the degree of slope is given by the formula:

$$Y=(A-C)/(A+C)\times 200.$$

When X is positive, the fibres are less dense at the centre than at the edges.

FIG. 8 shows schematically, according to the values for hollowness and slope, the general form of distribution of the fibres transversely to the conveyor. It should be understood that, in practice, a form representing the hollowness should be combined with one representing the slope.

In a first series of tests, a product is produced at the rate of 6 tonnes per hour. The felt obtained has an average mass per unit surface area of 5.5 kg/m$^2$. The binder content of the mass of felt is 6.6%.

The average quantity of gas sucked through the conveyor is of the order of 175000 Nm$^3$/h.

The quantities of gas ejected along the walls are varied and the development of the slope and hollow are observed.

The results are summarized in the attached Table I.

The initial distribution is poor, as shown in Example 1. The degrees of hollow and slope are both relatively high in contrast to an ideal distribution, in which they should be both zero.

In a distribution of this type, that is to say, one in which the present invention is not employed, the quantity of fibres required to provide the required density at every point of the felt is substantially increased. This operation is not satisfactory.

In Examples 2 to 6, the nozzles according to the present invention are operated at different pressures.

It will be seen that due to the difference in configuration between the circuit on the left side and on the right side, the flow rates for a given pressure are not identical. This does not constitute an obstacle to satisfactory operation if each nozzle is controlled separately.

Examples 2, 3, 4 and 5 show the progressive effects obtained with increasing pressure acting simultaneously on the two nozzles. The hollowness and slope are both substantially reduced and the degree of hollowness even becomes negative.

Example 6 (which does not provide satisfactory distribution) was carried out to demonstrate the effect of using two different pressures. It may be seen that the slope may be profoundly modified by the difference in pressure. This difference may therefore be employed to obtain a partially independent variation of the hollowness and the slope.

It goes without saying that the distribution of fibres on the conveyor responds to numerous factors, in particular to the characteristics of the product being produced.

Tests analogous to those described above were carried out in the course of production of a felt having other characteristics. The felt in this case had a mass per unit surface area of 5.2 kg/m$^2$ and a binder content of 2.4%.

The results, analogous to those described above, are summarized in the attached Table II.

In these tests, the progressiveness of the effects obtained is confirmed. No attempt was made to equalize the two edges of the felt. The pressures on the two sides of the felt were identical but it will be seen that in order to obtain better distribution, it is necessary to employ different conditions in the jet on the right to those on the left.

The results obtained in the tests described above are represented graphically in FIGS. 9 and 10.

These figures show, respectively, the degrees of hollowness (FIG. 9) and of slope (FIG. 10) for the two series of tests described above (I and II).

It will be seen that within the limits of the experimental conditions employed, the modifications are virtually linear. Regardless, of the direction of the response, what is important, as we have already pointed out, is the progressiveness of the effect, which enables the installation to be controlled so that a very regular distribution may be achieved.

The blast devices according to the present invention may be operated automatically.

Adjustment is in that case carried out continuously from measurements obtained from the X-ray absorption probe. The values measured are computerized to provide, for example, expressions for the degree of hollowness and of slope. An algorithm put into the memory uses these results to provide a response corresponding to a modification of the flow emitted from the nozzles according to the invention by means of valves provided in the pipes.

The possibility of continuous variation of the gas flow provides a perfect control means adapted to all situations encountered in practice.

TABLE I

| | mmCE pressure left | Nm$^3$/h flow rate left | mmCE pressure right | Nm$^3$/h flow rate right | X % | Y % |
|---|---|---|---|---|---|---|
| 1 | 0 | 0 | 0 | 0 | +15.6 | +18.12 |
| 2 | 250 | 2500 | 250 | 2160 | +3.91 | +5.65 |
| 3 | 325 | — | 325 | — | +4 | +2.16 |
| 4 | 375 | 3100 | 375 | 2550 | −1.33 | — |
| 5 | 500 | 3780 | 500 | 3100 | −3.9 | +1.87 |
| 6 | 500 | | 325 | | −3.13 | −8.96 |

TABLE II

| | Pressure left mmCE | Pressure right mmCE | X | Y |
|---|---|---|---|---|
| 7 | 0 | 0 | +6.22 | −0.35 |
| 8 | 100 | 100 | +2.96 | −0.68 |
| 9 | 200 | 200 | +0.09 | −5.94 |
| 10 | 300 | 300 | −1.85 | −5.49 |
| 11 | 400 | 400 | −5.96 | −5.39 |

I claim:

1. Process for the formation of a felt of fibres, in which the fibres are formed from a material in an attenuable state, this material being conducted to the peripheral surface of one or more than one wheel subjected to a movement of rotation, from which the fibres become detached to be projected into a gas current directed transversely to the direction of projection of the fibres along the peripheral wall of the wheel or wheels, the fibres thus formed, entrained by the gas current, being conducted into a receiving chamber in which a perforated conveyor constitutes the base thereof, the gas current carrying the fibres passing through the conveyor and the fibres being deposited on the conveyor to form the felt, which process is characterised in that one or more additional gas jets are produced on each side of the gas current carrying fibers, substantially in the same direction as the said current, these additional jets being emitted along the side walls bordering the perforated conveyor, the mass of additional gas introduced being regulated separately on each side as a function of the correction in distribution to be produced, the transverse distribution of the fibres in the felt being controlled continuously, the measurements carried out being analyzed and compared with the required values in a computer producing responses in the form of a command for controlling the means regulating the emission of additional gas.

2. Process according to claim 1, characterised in that the additional jets are emitted at velocities of the same order of magnitude or higher than that of the gas current carrying the fibres at this level.

3. Process according to claim 1 or claim 2, characterised in that the mass of gas introduced is at the most equal to 1/50th of the mass of gas current carrying the fibres.

4. Process according to claim 1, characterized in that the additional jets are emitted in a direction parallel to the plane of the conveyor and at an angle of at the most 20° with the plane of the side walls of the receiving chamber.

5. Process according to claim 1, characterized in that the jets are emitted in the form of planar sheets of gas substantially parallel to the side walls of the receiving chamber.

6. Installation for the formation of a felt of fibres, comprising a fibre-forming assembly consisting of one or more centrifugation wheels to which the material is conducted from the outside, blast means producing a gas current along the periphery of the centrifugation wheels, a fibre-receiving chamber elongated in the direction of progression of the gas current carrying the fibres, the said chamber having a perforated conveyor at its base, bordered laterally by two walls, suction means being situated underneath the conveyor, characterized in that additional blast means are arranged close to the side walls, the orifices of the blast means being directed so that the gas emitted extends along the side walls, means for measuring the distribution of the fibres transversely to the formed felt, a calculating device for processing these measurements to compare the results with predetermined values and produce responses in the form of commands for controlling the means of regulating the emission of additional gas.

7. Installation according to claim 6, in which the blast means consist, on each side of the fibre receiving chamber, of a plurality of blast nozzles spaced apart vertically along the end of the side walls.

8. Installation according to claim 6, characterized in that blast means comprise, on each side, a single nozzle elongated vertically along the side walls.

* * * * *